US005549158A

United States Patent [19]

Hart

[11] Patent Number: 5,549,158

[45] Date of Patent: Aug. 27, 1996

[54] FIELD INSTALLED SLOTTED ROD GUIDE AND METHOD

[75] Inventor: Charles M. Hart, Stinnett, Tex.

[73] Assignee: J. M. Huber Corporation, Tomball, Tex.

[21] Appl. No.: 437,936

[22] Filed: May 9, 1995

[51] Int. Cl.[6] ..... E21B 17/10

[52] U.S. Cl. ..... 166/241.4

[58] Field of Search ..... 166/241.1, 241.2, 166/241.4, 241.6

[56] References Cited

U.S. PATENT DOCUMENTS

| | | | |
|---|---|---|---|
| 1,560,468 | 11/1925 | Dodson | 166/241.4 |
| 1,729,175 | 9/1929 | Meier | 166/241.4 |
| 2,604,364 | 7/1952 | Ward | 166/241.4 |
| 2,793,917 | 5/1957 | Ward | 166/241.4 |
| 3,001,834 | 9/1961 | Bowerman | 166/241.4 |
| 3,330,358 | 7/1967 | Ward | 166/241.4 X |
| 3,414,337 | 12/1968 | Sable | 166/241.4 |
| 3,650,579 | 3/1972 | Sable | 166/241.4 |
| 4,575,163 | 3/1986 | Sable | 166/241.4 X |
| 4,632,468 | 12/1986 | Wilson et al. | 166/241.4 |
| 4,858,688 | 8/1989 | Edwards et al. . | |
| 4,938,285 | 7/1990 | Edwards et al. . | |
| 5,154,867 | 10/1992 | Edwards et al. . | |

*Primary Examiner*—Frank Tsay

*Attorney, Agent, or Firm*—Browning, Bushman, Anderson & Brookhart

[57] ABSTRACT

A rod guide 10 may be installed on a sucker rod by two distinct impacts with a hammer or mallet. The rod guide 10 includes a slot 30 having a throat 38 defining therein a catch section 50 wherein a sucker rod 22 will be temporarily caught and held after the first impact. The catch section is spaced between a first restricted throat width and a second restricted throat width of the slot 30. On the second impact, the rod guide 10 is driven relative to the sucker rod past the second restricted throat width and into the rod guide bore 18. An entry port 32 is preferably provided with a radiused opening that widens to a curved surface defining the first restricted throat width. Each opposing wall of the throat 38 may be defined by first, second, and third curvilinear surfaces each having a respective center.

20 Claims, 1 Drawing Sheet

FIELD INSTALLED SLOTTED ROD GUIDE AND METHOD

BACKGROUND OF THE INVENTION

1. Field of the Invention

The present invention relates generally to rod guides for use in hydrocarbon producing wells and, more particularly, to a plastic rod guide having an improved slot therein for a facilitating installation of the rod guide onto a sucker rod.

2. Description of the Background

Rod guides have been used for years to minimize wear on both sucker rod strings and on tubular strings. Sucker rod strings are typically provided within a tubular string to operate a downhole pump that is designed to pump production fluid upwardly through the annulus between the tubular string and the sucker rod string. Rod guides are typically utilized to centralize and guide the sucker rod string within the tubular string and thereby prevent wear caused by metal-to-metal scraping between the sucker rod and the tubular string. Rod guides may also serve as scrappers to clean paraffin or other material off the inside of the tubular string. A plurality of rod guides are preferably axially spaced at regular intervals along the sucker rod string of a well using a downhole pump to recover oil. The pump may be powered by either rotation or reciprocation of the sucker rod string.

One type of rod guide includes a generally cylindrical-shaped, longitudinally slotted guide body with a longitudinal internal bore that is preferably slightly undersized with respect to the diameter of the sucker rod on which the rod guide is installed. An expandable body slot extends longitudinally through the entire length of the rod guide and provides a means for securely mounting the rod guide at a desired location on the sucker rod. The rod guide may be affixed to the sucker rod by initially placing the rod guide against the sucker rod with the mouth or entry port of the expandable body slot lying adjacent and in line with the sucker rod. The rod guide is then struck sharply with a hammer or mallet to momentarily spring the body slot open and force the rod guide onto the sucker rod. The sucker rod will then seat securely in the preferably slightly undersized internal bore of the rod guide. The rod guide preferably is secured to the sucker rod so that the rod guide stays in position on the rod over the extended life of the rod guide as the sucker rod is reciprocated or rotated within the tubular string. For this reason, the configuration of the rod guide body and the material for the rod guide may be designed to provide a strong biasing action to securely grip the sucker rod, as disclosed in U.S. Pat. No. 4,858,688.

Problems sometimes occur during installation of the rod guide onto the sucker rod due to this desired strong biasing action. Often, many mallet blows are necessary to install the rod guide onto the sucker rod, thereby increasing installation time. These repeated mallet blows may also damage the rod guide. Sometimes, during or after the first blow, the rod guide may pop back off the sucker rod towards the operating personnel.

Various designs for a slot in a rod guide have been provided. Slots have been used that have a slot cross-section, with respect a horizontal plane perpendicular to the internal bore of the guide, that has straight substantially parallel slot walls. As well, rod guide slots have been designed that have planar slot walls that are tapered. In one tapered slot design, the mouth or entry port into the slot is wide and tapers through the throat of the slot to a smaller width at the exit port of the slot (which opens to the internal bore of the rod guide). Another design has a relatively small mouth or entry port that tapers through the throat of the slot to a somewhat wider slot exit port. Examples of these rod guides are disclosed in U.S. Pat. Nos. 4,938,285 and 5,154,867. Some knock-on rod guides include circumferentially spaced slots to form vanes which help clear paraffin off the tubing.

The slot designs for these rod guides affect the likelihood that the rod guide will pop back at the operating personnel, but do not alleviate this concern. Many blows to the rod guide may still be required to effect installation. Some rod guide designs sacrifice long life of the rod guide by selecting a plastic material which is less durable when exposed to abrasive wellbore conditions, but may be reliably secured to a rod. Other designs utilize a durable plastic material, but the installed rod guide is susceptible to movement with respect to the rod after extended downhole use.

Consequently, there remains a need for a more dependable, less time consuming method for installing rod guides onto sucker rods to reduce costs and to decrease the likelihood of injury associated with such installation. A rod guide which may be more reliably installed and which will remain secured to a rod has a significant advantage over other rod guides. According to this invention, the configuration of the rod guide and the material selection for the guide body may be optimized with less regard to installation difficulty. Those skilled in the art have long sought and will appreciate the present invention which provides solutions to these and other problems.

SUMMARY OF INVENTION

The rod guide and method of the present invention may be used to facilitate reliable installation of a rod guide onto a sucker rod used within an oil producing well. The installed rod guide reliably remains secured to the sucker rod during downhole use, and has a long life.

The rod guide body has an outer surface used for guiding the sucker rod within a tubular string during rotation or reciprocation of the sucker rod string. The rod guide body has a guide bore therethrough with a diameter sized for receiving the sucker rod. The rod guide body defines a slot for receiving the sucker rod into the guide bore. The rod guide body is substantially flexible, such that the slot may be spread apart while receiving the sucker rod. The slot has a cross-section transverse to the guide bore with a radially outer mouth or entry port, and a radially inner exit port. The slot cross-section defines a throat starting with the entry port and ending with the exit port, which throat has a width between first and second opposing slot walls that varies as a function of the spacing between the entry port and the exit port. Each slot wall preferably defines a curvilinear plane which, throughout its throat length, is parallel to the central axis of the rod guide. The throat defines therein a catch section for restricting movement of the sucker rod as it moves through the slot into the guide bore. The catch section has an increased width for receiving the sucker rod compared with narrower slot widths both radially inward and radially outward of the catch section. In a preferred embodiment, the throat slot walls each have a curvilinear configuration throughout at least a substantial portion of the throat length between the entry port and the exit port.

The entry port of the slot has a selected entry port width and a first restricted throat width spaced radially inwardly from the entry port width with respect to the rod guide internal bore. A second restricted throat width is spaced radially inwardly from the first restricted throat width. The exit port of the slot to the internal bore has a selected exit port width. In one presently preferred embodiment, the radial space between the first restricted throat width and the second restricted throat width includes the catch section, which has opposing walls each with a concave planar surface. The width between the opposing concave surfaces is continually greater than both the first restricted throat width and the second restricted throat width. In a preferred embodiments, each of the opposing slot walls is substantially defined by first, second and third curvilinear surfaces each having a respective center.

The method of this invention provides for mounting a rod guide onto a sucker rod such that the sucker rod becomes secured within the internal bore of the rod guide. The method comprises forming a preselected rod guide catch section within the slot between the entry port and the exit port. The rod guide is positioned against the sucker rod with the rod guide oriented such that the slot is substantially parallel to the sucker rod. A first force is applied to the rod guide relative to the sucker rod by a mallet to move the rod guide such that the sucker rod fits within the preselected rod guide catch section within the throat of the slot. A second force is then applied to the rod guide to move the rod guide from the preselected rod guide catch section to a position such that the rod is positioned within the inner rod guide bore. The rod guide is thereby securely affixed to the rod.

It is an object of the present invention to provide an improved rod guide and method of installing a rod guide.

It is another object of this invention to provide a rod guide with an improved slot that allows reliable installation of the rod guide onto the sucker rod with two distinct impacts.

It is yet another object of the present invention to provide a rod guide design that provides for catching the sucker rod within the throat of the slot approximately midway between the throat entry port and the throat exit port of the rod guide.

A feature of the present invention is a curvilinear wall catch section within the throat of the rod guide slot having a diameter only slightly less than the diameter of the bore through the rod guide.

Another feature of the present invention is a rod guide with opposing slot walls each having concave and convex curved surfaces along the slot throat.

An advantage of the present invention is the reduction in difficulty of installing the rod guide onto the sucker rod.

Another advantage of this invention is a reduced likelihood of injury due to the rod guide popping off the rod during installation.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1:
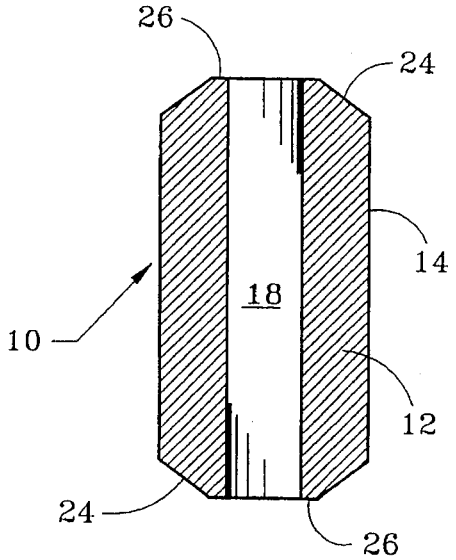
FIG. 1 is an elevational view, in cross-section, of a rod guide in accord with the present invention.

Referring now to the drawings, and more particularly to FIG. 1, the general features of rod guide 10 in accord with the present invention are illustrated. Rod guide 10 may be homogeneously formed from an elastomeric material, such as plastic. In a preferred embodiment, the rod guide material is an ultra-high molecular weight (UHMW) polyethylene. The selected material for rod guide 10 results in the rod guide being sufficiently flexible such that the guide may be installed on a sucker rod as described hereafter.

Rod guide 10 includes an elongate substantially cylindrical guide body 12 having an outer circumferential surface 14. The diameter of surface 14 is less than the internal diameter of the tubing in which the rod guide is placed. In one embodiment, the surface 14 is sized to prevent the couplings on a rotating sucker rod from engaging the tubing. Alternatively, the rod guide may be installed on a reciprocating rod, and may include longitudinal vanes as described subsequently to clear paraffin from inside surfaces of the tubing (not shown), while allowing fluid to flow past the rod guide.

Rod guide 10 has a rod guide bore 18 therethrough for receiving a sucker rod. Typically, the diameter of rod guide bore 18 is undersize, by for example about 1/16 inch, with respect to the diameter of the sucker rod. This undersizing achieves a secure seating of the rod guide on the sucker rod. Top and bottom tapers 24 are preferably provided at each end of the guide to facilitate flow of fluids past the guide. Top and bottom planar surfaces 26 on each end of the guide may be provided to avoid a sharp edge.

Figure 2:
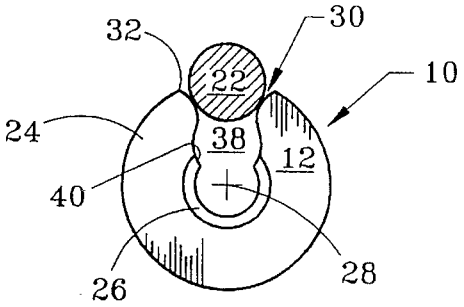
FIG. 2 is a top view of the rod guide as shown in FIG. 1 with the guide in initial engagement with the rod.
Figure 3:
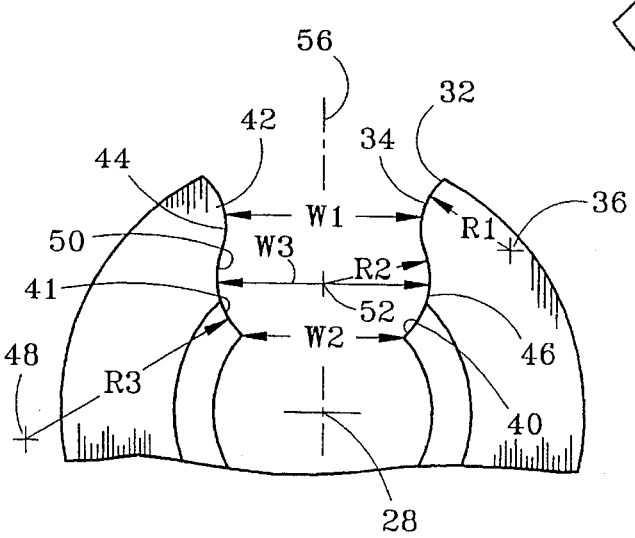
FIG. 3 is an enlarged top view of a portion of the rod guide shown in FIG. 2.

Referring to FIGS. 2 and 3, rod guide 10 includes a longitudinal slot 30 in accord with the present invention. FIG. 2 depicts a top view of rod guide 10 transverse to the central axis 28 of the guide bore 18 so that a cross-sectional profile of slot 30 within guide body 12 may be viewed. Slot 30 has a throat 38 that extends from entry port 32 to exit port 40. Throat 38 is defined by opposing slot walls 44 and 46 that preferably mirror each other so as to form a symmetrical throat 38. Opposing walls 44 and 46 could, however, be shaped differently from each other, if desired. Throat 38 has a width between walls 44 and 46 that varies substantially continually along the length of throat 38 between the entry port and the exit port. Preferably each wall 44 and 46 is continuously vertical as shown in FIGS. 2 and 3, so that each wall along its length lies within a plane parallel to the central axis 28 of the rod guide 10.

As shown more clearly in FIG. 3, entry port 32 is provided with an outwardly directed convex curved surface 34 on each wall 44 and 46. Curved surface 34 is a radiused surface defined by a first radius R1 having centerpoint 36. Centerpoint 36 is located outside of throat 38. Another centerpoint (not shown) disposed at a mirror image position is also provided for the curved surface 34 on the opposing wall 44. Surface 34 is convex as viewed from within throat 38. Thus, the opposing curves surface 34 are separated by a width at entry port 32 that is larger than the first restricted width W1 formed by these convex surfaces 34 and disposed radially inwardly from entry port 32. The curved surfaces 34 thus form inwardly projecting lobes 42 which define the first restricted width W1.

The opposing slots walls 44 and 46 also define catch section 50 including opposed curved surfaces each defined by a second radius R2 from a centerpoint 52 within throat 38. The centerpoint 52 may be the center for both curved surfaces of the catch section, or two spaced centers may define these curved surfaces. In either design, the center for each curved surface is within the slot 30, and preferably is adjacent the centerline 56 of the slot. Catch section 50 thus includes concave surfaces as viewed from within throat 38. The maximum width W3 of catch section 50 is greater than width W1 of the first restriction W1 formed by lobes 42, and also greater than width of exit port 40. Catch section 50 is designed to temporarily catch and hold sucker rod 22 as it moves inward toward bore 18. Catch section 50 is preferably provided in a presently preferred embodiment substantially midway along the radial pathway of throat 38, i.e., approximately midway between the entry port 32 and the exit port 40.

The opposing walls of exit port 40 are each formed by a curved surface 41 defined by a third radius R3 having a center 48 outside the slot. Curved surface 41 is concave as viewed from within throat 38, but is less concave, or slopes more smoothly, than catch section 50 due to a larger radius R3. Width W2, in the FIG. 3 embodiment, is the minimum width through throat 38. Width W2 also defines a second restricted width radially inward from the first restricted width W1.

The diameter of the rod guide may be increased while the bore 18 and the configuration of the slot 30 remains substantially as shown. The convex curved surfaces 34 may each continue radially outward from the slot entry port 32 depicted in FIG. 3, with the centerpoint 36 continuing to define the curved surface which extends to the larger outer diameter of the guide. The width of the entry port 32 will be greater than the width between the curved surfaces 34 at the contact points with the rod, so that the contact points are spaced inwardly from the external surface of the guide, as shown in FIG. 2.

In operation, slot 30 is designed to provide a two impact method of installing a rod guide 10 so that the sucker rod 22 fills bore 18. Rod guide 10 is first aligned with the sucker rod such that the sucker rod is oriented in contact with entry port 32. The first impact, which may be made with a hammer or mallet against rod guide 10 at a location radially opposite the slot, moves rod guide 10 with respect to sucker rod 22, such that sucker rod 22 moves past lobes 42, and stops within catch section 50. Due to the smooth surface 34 that curves gently from the entry port 32 to the restricted width W1 between the lobes 42, sucker rod 22 slips relatively easily into catch section 50 on the first impact. Once sucker rod 22 is positioned within catch section 50, a second impact against rod guide 10 drives rod guide 10 over the sucker rod 22 such that sucker rod 22 is within bore 18. The two-impact method and construction prevents the likelihood that the rod guide will pop off the sucker rod during installation. By specifically designating two movements of the guide relative to the rod into two distinct regions, a relatively decreased impact for each movement is required.

Referring still to FIG. 3, the width of the slot entry port 32 may vary as a function of the diameter of the rod guide, as explained above. Each opposing convex surface 34 preferably extends from the entry port 32 to the first restricted throat width W1 as defined by the radius R1 and its respective center 36. This convex surface then smoothly changes to a concave surface to define the catch section, with each concave surface having a center 52. Moving radially inward, this concave surface continues, although its configuration adjacent the slot exit port is determined by the third center 48. The radiused surfaces smoothly change from one center to another center to avoid sharp edges or breaks along the opposing slot walls. As shown in FIG. 3, each slot wall 44 and 46 may have a generally S-shaped configuration. At least a substantial length of each slot wall between the entry port and the exit port has a curvilinear configuration.

Figure 4:
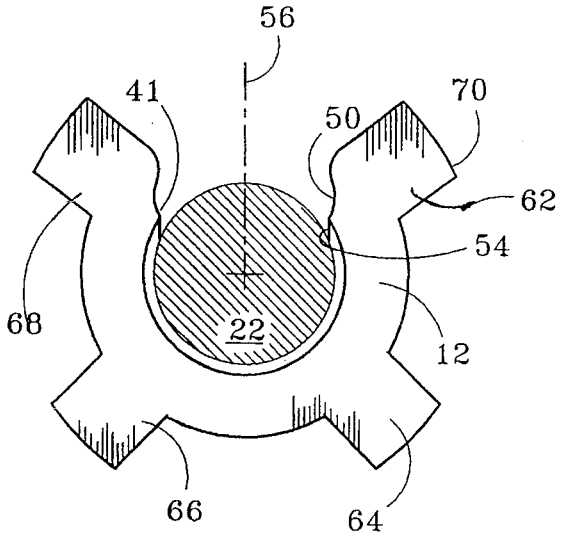
FIG. 4 is a top view of an alternative embodiment of a rod guide, with the sucker rod extending through the bore in the rod guide.

FIG. 4 discloses an alternative embodiment of the present invention wherein a plurality of vanes 62, 64, 66 and 68 extend radially outward from the generally cylindrical body 12 of the rod guide. The rod guide as shown in FIG. 4 is particularly suited for use on a reciprocating rod string. The radially outer surface 70 of the vanes may be sized for sliding engagement with the tubular. The arcuate length of the vanes may be increased so that relatively narrow gaps separate the vanes, as shown in U.S. Pat. No. 5,154,867.

FIG. 4 also discloses opposing slot walls including a short straight line portion 54 radially inward of both catch section 50 and curved surface 41. The walls of straight line portion 54 may be parallel to a centerline 56 of the slot. Alternatively, the slot straight line portions could be slanted for increasing the ease of movement of sucker rod 22 on rod guide 10. A tool may be used to cut the desired slots in various sized guides. The straight line portions 54 achieve the desired width of the exit port 40 for ease of installation and reliable retention of the guide on the rod. A straight line portion or portions could be included anywhere along throat 38, as desired, although preferably at least a substantial length of each surface 44 and 46 is curvilinear.

It will be understood that the various radii which define the curvilinear surfaces of the slot walls, that preferably include at least three radii such as R1, R2, and R3, may be adjusted to vary the widths along the radial length of throat 38. Thus, longer radii will accommodate a narrower throat width between walls 44 and 46 for relative passage of sucker rod 22 through throat 38. Shorter radii will require a generally larger throat width to be used. Adjustments of throat region widths and the radii or slope of the curved regions of the throat region may be used to thereby adjust the installation force used to move the rod guide over the sucker rod.

Thus, the present invention provides for a throat design that allows the rod guide to be securely positioned onto the sucker rod by dividing the process of installation into two segments whereby two relatively light impacts may be used to install the rod guide of the present invention with greatly reduced possibility of the rod guide popping off the sucker rod.

Prior to installation of the rod guide on the rod, the maximum width W3 of the curved surfaces catch section 50 is from 75% to 100%, and preferably from about 80% to about 95% of the diameter of the bore 38 through the rod 10. The concave surfaces of the curved surface catch section thus lie along portions of a circle whose diameter is only slightly less than the diameter of the bore through the rod guide. The width W1 of the first restricted width of the slot is from 65% to 95%, and preferably 70% to 90% of the diameter of the rod guide bore. The first restriction width provides the desired restriction to retain the rod guide on the rod temporarily within the catch section 50. The second restricted width provides the desired spacing to securely retain the rod guide on the rod as shown in FIG. 3. The width W2 is from 50% to 75%, and preferably from about 55% to 70%, of the diameter of the rod guide bore.

Those skilled in the art will understand that, while the preferred embodiment of the invention includes a homogeneous plastic material for the body 12, the rod guide could be fabricated from different materials. Two rigid halves of the rod guide could be formed and a flexible hinge provided opposite the slot to retain the two body halves together. Alternatively, a portion of the rod guide opposite the slot could be fabricated from a plastic material to provide the desired biasing force, and each side of the rod guide body then interconnected with the plastic material, The foregoing disclosure and description of the invention is illustrative and explanatory thereof. It will be appreciated by those skilled in the art that various changes in the size, shape and materials as well as in the details of the illustrated construction or combinations of features of the various rod guide elements and designs may be made without departing from the spirit of the invention.

What is claimed is:

1. A rod guide for mounting on a sucker rod, the rod guide including a rod guide body having an outer body surface, the rod guide body having a rod guide bore therethrough with a bore wall for fixedly engaging the sucker rod, the rod guide body defining a slot for receiving the sucker rod into the rod guide bore, the rod guide body being substantially flexible for expanding the slot to pass the sucker rod through the slot and into the bore, the slot having a cross-section transverse to a central axis of the rod guide bore with an entry port and an exit port, the improvement comprising:

the slot cross-section having a first restricted throat width radially inward of the entry port, and a second restricted throat width radially inward of the first restricted throat width, a radial spacing between the first restricted throat width and the second restricted throat width including a catch section for temporarily receiving the sucker rod, the catch section having a continuous width greater than both the first restricted throat width and the second restricted throat width.

2. The rod guide as defined in claim 1, further comprising:

the entry port having an entry port width, the exit port having an exit port width substantially equal to the second restricted throat width, and the entry port width being greater than a widest portion of the catch section.

3. The rod guide as defined in claim 1, the slot further comprising:

first and second opposing slot walls each defining a concave plane parallel to the central axis of the rod guide between the first and second restricted throat widths.

4. The rod guide as defined in claim 3, wherein:

at least a substantial length of each of the first and second opposing slot walls between the entry port and the exit port has a curvilinear configuration.

5. The rod guide as defined in claim 1, the slot further comprising:

first and second opposing slot walls each having a first, a second and a third curvilinear surface each having a respective first, second and third center.

6. The rod guide as defined in claim 1, further comprising:

first and second slot walls have a substantially identical and opposing configuration that mirrors the opposing slot wall.

7. The rod guide as defined in claim 1, further comprising:

each of first and second opposing slot walls are curved throughout substantially a radial spacing between the entry port and the exit port.

8. The rod guide as defined in claim 1, further comprising:

each of first and second opposing slot walls includes a convex surface between the entry port and the first restricted throat width.

9. The rod guide as defined in claim 1, wherein the catch section has a maximum width from 75% to 100% of a diameter of the rod guide bore.

10. The rod guide as defined in claim 9, wherein the first restricted width is from 65% to 95% of the diameter of the rod guide bore.

11. A rod guide for mounting on a sucker rod within a tubular, the rod guide comprising:

a rod guide body having an outer body surface for guiding engagement with the tubular and a guide bore therethrough for receiving the sucker rod, the rod guide body defining a slot for passing the sucker rod through the slot and into the bore, the slot having a cross-section transverse to a central axis of the guide bore with an entry port and an exit port, the slot cross-section having opposing side walls forming a first restricted throat width defined by opposing convex side walls each having a center exterior of the slot, a second restricted throat region radially inward of the first restricted throat region, and a curved surface catch section spaced radially between the first restricted throat width and the second restricted throat width and having concave side walls each having a center within the slot.

12. The rod guide as defined in claim 11, wherein:

the curved surface catch section has a maximum width from 70% to 100% of a diameter of the rod guide bore.

13. The rod guide as defined in claim 11, wherein:

the first restricted throat width is from 65% to 95% of the diameter of the rod guide bore.

14. The rod guide as defined in claim 11, wherein:

each side wall of the slot has a substantially S-shaped cross-sectional configuration.

15. The rod guide as defined in claim 11, wherein:

at least a substantial length of each of the opposing slot walls between the entry port and the exit port has a curvilinear configuration.

16. The rod guide as defined in claim 11, further comprising:

each of the opposing slot walls includes a convex surface between the entry port and the first restricted throat width.

17. A method for securing a rod guide onto a sucker rod, the rod guide having an inner rod guide bore and a longitudinal slot for receiving the sucker rod within the rod guide bore, the method comprising the following steps:

forming a preselected rod guide catch section within the slot between an entry port and an exit port of the slot, the catch section having a width continuously greater than a radially outward first throat restriction and a radially inward second throat restriction;

positioning the rod guide adjacent the sucker rod such that the longitudinal slot in the rod guide is substantially parallel to the sucker rod and the rod guide is adjacent the entry port of the slot;

applying a first force to the rod guide to move the rod guide such that the sucker rod fits within the preselected catch section within the longitudinal slot; and applying a second force to the rod guide to move the rod guide from the preselected catch section within the longitudinal slot and through the exit port of the slot such that the rod guide fits within the inner rod guide bore.

18. The method as defined in claim 17, wherein the step of applying a second force comprises striking the rod guide at a location radially opposite the longitudinal slot.

19. The method as defined in claim 17, further comprising:

forming the preselected catch section approximately midway between the entry port of the slot and the exit port of the slot; and forming the preselected catch section with opposing slot walls each having a concave configuration.

20. The method as defined in claim 17, further comprising:

forming at least a substantial length of first and second opposing slot walls between an entry port and an exit port of the slot with a curvilinear configuration.

* * * * *